US010465350B2

(12) United States Patent
Polley

(10) Patent No.: US 10,465,350 B2
(45) Date of Patent: Nov. 5, 2019

(54) DEVICE FOR PICK-UP, HANDLING AND TRANSPORT OF HAZARDOUS WASTE AND RELATED PARAPHERNALIA

(71) Applicant: Michael A. Polley, Ashland, KY (US)

(72) Inventor: Michael A. Polley, Ashland, KY (US)

( * ) Notice: Subject to any disclaimer, the term of this patent is extended or adjusted under 35 U.S.C. 154(b) by 0 days.

(21) Appl. No.: 16/217,124

(22) Filed: Dec. 12, 2018

(65) Prior Publication Data

US 2019/0176294 A1 Jun. 13, 2019

Related U.S. Application Data

(60) Provisional application No. 62/597,508, filed on Dec. 12, 2017.

(51) Int. Cl.
*E01H 1/12* (2006.01)
*B25B 9/00* (2006.01)

(52) U.S. Cl.
CPC ..... *E01H 1/12* (2013.01); *B25B 9/00* (2013.01); *E01H 1/1206* (2013.01)

(58) Field of Classification Search
CPC . E01H 1/12; E01H 1/1206; B25B 9/00; B25J 15/0038
USPC ..... 294/1.3, 16, 99.2, 219; 24/502, 509–511
See application file for complete search history.

(56) References Cited

U.S. PATENT DOCUMENTS 1,133,388 A 3/1915 Merrill et al.
D259,968 S 7/1981 Schneider
4,829,999 A 5/1989 Auth
5,143,414 A * 9/1992 Rosellini ..... A61M 5/3213 128/919
5,382,063 A * 1/1995 Wesener ..... E01H 1/1206 15/257.6
5,503,442 A 4/1996 Lee
5,556,150 A * 9/1996 Ampel ..... B25B 7/00 294/118
D429,040 S * 8/2000 Schmittgens ..... 294/1.3
7,635,153 B2 * 12/2009 Anderson ..... E01H 1/1206 294/1.3
8,216,258 B2 7/2012 Skipper
8,770,642 B1 * 7/2014 Jason ..... B25B 9/02 294/212
D756,572 S 5/2016 Baker
9,624,631 B2 4/2017 Baker
9,803,327 B1 * 10/2017 Anderson ..... E01H 1/1206
(Continued)

FOREIGN PATENT DOCUMENTS

CN 205215369 U 5/2016
CN 205460183 U 8/2016

OTHER PUBLICATIONS

CN205215369 English Machine Translation.
CN205460183 English Machine Translation—Abstract only available.

*Primary Examiner* — Dean J Kramer
(74) *Attorney, Agent, or Firm* — King & Schickli, PLLC

(57) ABSTRACT

A device is provided for picking up, handling and transporting medical and/or hazardous waste. The device includes a body having an upper section and a lower section and a clip hinge connecting the upper section to the lower section. The clip hinge is configured to translate the body between an open position wherein the upper section and the lower section are spaced apart and a closed position wherein the upper section and the lower section are engaged to form a sealed container.

13 Claims, 7 Drawing Sheets

(56) References Cited

U.S. PATENT DOCUMENTS

| | | | | |
|---|---|---|---|---|
| 2008/0303295 | A1* | 12/2008 | Moreno Fernandez De Betono | E01H 1/1206 294/1.3 |
| 2009/0261603 | A1* | 10/2009 | Boghozian | E01H 1/1206 294/1.3 |
| 2010/0026022 | A1* | 2/2010 | Welch | A01K 27/006 294/1.3 |
| 2011/0193359 | A1 | 8/2011 | Howard | |

* cited by examiner

DEVICE FOR PICK-UP, HANDLING AND TRANSPORT OF HAZARDOUS WASTE AND RELATED PARAPHERNALIA

This application claims the benefit of U.S. Provisional Patent Application Ser. No. 62/597,508, filed on Dec. 12, 2017, the disclosure of which is incorporated herein by reference.

TECHNICAL FIELD

This disclosure relates generally to devices for pick-up, handling and transport of hazardous waste and, more particularly, to a novel and improved device for picking up and disposing various forms of medical and/or hazardous waste to protect the individual handling the device from contact with the medical and/or hazardous waste.

BACKGROUND

It is well known that medical and/or hazardous waste is often not disposed of properly and the public may come into contact with such medical and/or hazardous waste, including but not limited to drug paraphernalia, drugs, spoons, syringes, needles, etc. For example, medical, EMT personnel, police, fire and rescue, teachers and other persons may come into contact with such paraphernalia on a daily basis and need to handle, transport and/or remove the paraphernalia to protect the public. It is not safe to pick up such hazardous materials with your bare hands and even utilizing rubber or protective gloves will not necessarily prevent puncture of the gloves and exposure to the hazardous materials.

While it is known to use pliers or other devices to pick up the hazardous materials as well as certain devices for picking up animal feces, these devices suffer from certain disadvantages. For example, most of these devices do not allow for proper handling and/or transport of the hazardous materials as they fail to encapsulate the hazardous materials. Furthermore, many of these devices are quite complex, which increases the cost and ease of manufacturing as well as the ease of use and transport.

Accordingly, there is a need for an improved device for handling and transporting hazardous materials and waste, which provides increased protection and safety for the individual transporting the hazardous materials as well as the public at large by enclosing, sealing and locking the hazardous material for more efficient transport to the appropriate disposal location.

SUMMARY

In accordance with one aspect of the disclosure, a device for picking up, handling and transporting medical and/or hazardous waste is provided. The device includes a body having an upper section and a lower section and a clip hinge connecting the upper section to the lower section. The clip hinge is configured to translate the body between an open position wherein the upper section and the lower section are spaced apart and a closed position wherein the upper section and the lower section are engaged to form a sealed container.

In one possible embodiment, the body of the device may be cylindrical. Furthermore, the upper section may be formed of a transparent plastic material, while the lower section may be formed of an opaque plastic material. The transparent plastic material may imprinted with a logo or decal.

In another embodiment, the top section may have a substantially inverted U-shaped cross-section and the bottom section may have a substantially U-shaped cross-section.

In yet another embodiment, an interior of each of the top and bottom sections is substantially hollow defining a cavity for holding and transporting waste products. Furthermore, the bottom section may have two opposed circular tabs to engage opposed ends of the upper section in the closed position.

In accordance with another aspect of the disclosure a device for picking up, handling and transporting medical and/or hazardous waste is provided. The device includes a first section having a first hollow interior and a second section opposed to the first section. The second section also has a second hollow interior, wherein the first and second sections are movable between an open position and a closed position. The device further includes a handle connecting the upper section to the lower section and a spring for the handle.

In one possible embodiment, the first hollow interior and the second hollow interior define a cavity for holding waste in the closed position. In another embodiment, the first section has a first outer edge extending around an entirety of the first section and the second section has a second outer edge extending around an entirety of the second section. The first outer edge is substantially flush with the second outer edge in the closed position.

In yet another possible embodiment, the handle includes a first portion connected to the first section. The handle also includes a second portion connected to the second section. The first portion of the handle and the second portion of the handle are connected via a hinge mechanism, which includes two opposed projecting tabs connected to a mounting block. The two opposed projecting tabs may be connected to the mounting block via a fastener.

In accordance with yet another aspect of the disclosure, a device for picking up, handling and transporting medical and/or hazardous waste is provided. The device includes a spring-activated handle and opposed sections connected to one another by the spring-activated handle. The opposed sections move between a working position wherein the opposed sections are spaced apart and a neutral position wherein the opposed sections contact each other to form a completely enclosed container.

In one embodiment, an external force may act on the spring-activated handle to move the opposed sections from the neutral position to the working position.

BRIEF DESCRIPTION OF THE DRAWINGS

The accompanying drawings incorporated in and forming a part of the specification, illustrate several aspects of this disclosure, and together with the description serve to explain the principles of the disclosure. In the drawings.

DETAILED DESCRIPTION

In the following detailed description, reference is made to the accompanying drawings that form a part hereof, and in which is shown by way of illustration, specific embodiments in which the invention may be practiced. These embodiments are described in sufficient detail to enable those skilled in the art to practice the embodiments and like numerals represent like details in the various figures. Also, it is to be understood that other embodiments may be utilized and that process or other changes may be made without departing from the scope of the disclosure. The following detailed description is not to be taken in a limiting sense, and the scope of the invention is defined only by the appended claims and their equivalents. In accordance with the disclosure, a device for pick-up, handling and transport of hazardous waste and paraphernalia is hereinafter described.

As shown in FIGS. 1-9, the device 10 for use in picking up, handling and transporting medical and/or hazardous waste, including but not limited to drug paraphernalia, drugs, spoons, syringes, needles, etc. is illustrated. The device 10 provides a simple, compact and convenient design that maximizes efficiency and safety in picking up, handling and transporting numerous types of medical and/or hazardous waste. It should be appreciated that the device 10 may be used by virtually any adult with little or no training. Advantageously, the device 10 allows medical and/or hazardous waste as well as related paraphernalia, such as needles and syringes to be picked up and transported in a safe way that protects the individual utilizing the device from coming into contact with any possible residues from the waste and needles.

The device 10 includes a cylindrical body 20, which has a first top section 30 and a second bottom section 40. While the device illustrated in FIGS. 1-9 is cylindrical, it should be appreciated that the device 10 may be made in different sizes and shapes for different uses. Typically, the device 10 is made from a relatively rigid material, such as hard plastic. The interior of each of the top and bottom sections 30/40 is substantially hollow defining a cavity (C) for holding and transporting waste products. Specifically, the top section 30 has a substantially inverted U-shaped cross-section, while the bottom section 40 has a substantially U-shaped cross-section. The top section 30 may be made of a transparent plastic material, so that the product to be captured may be viewed by the operator after being captured. Furthermore, the top section 30 may be imprinted with a logo or design or other marking indicating hazardous material. On the other hand, the bottom section 40 may be made of an opaque plastic material. Of course, it should be appreciated that the top and bottom sections 30/40 may be made of the same or different materials.

Figure 1:
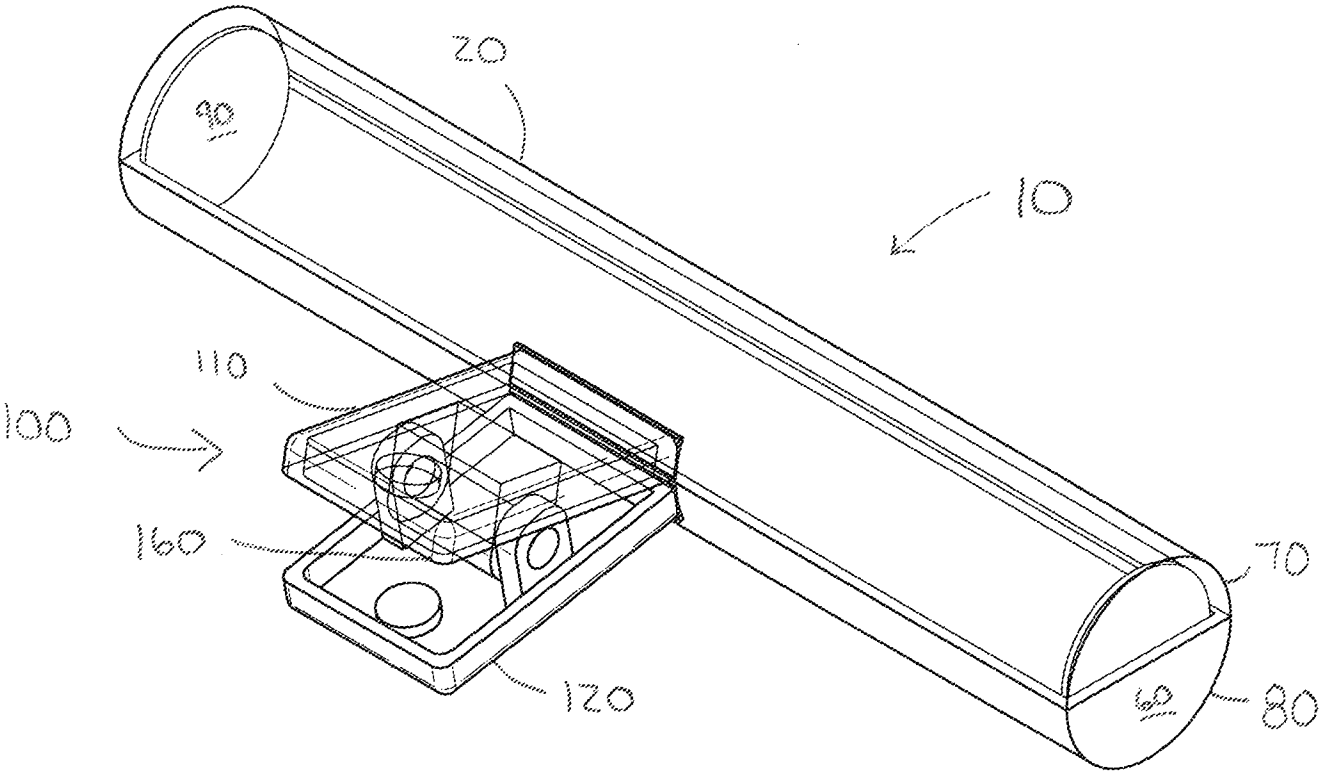
FIG. 1 is a top perspective view of a device for pick-up, handling and transport of hazardous waste and paraphernalia forming one aspect of this disclosure.
Figure 2:
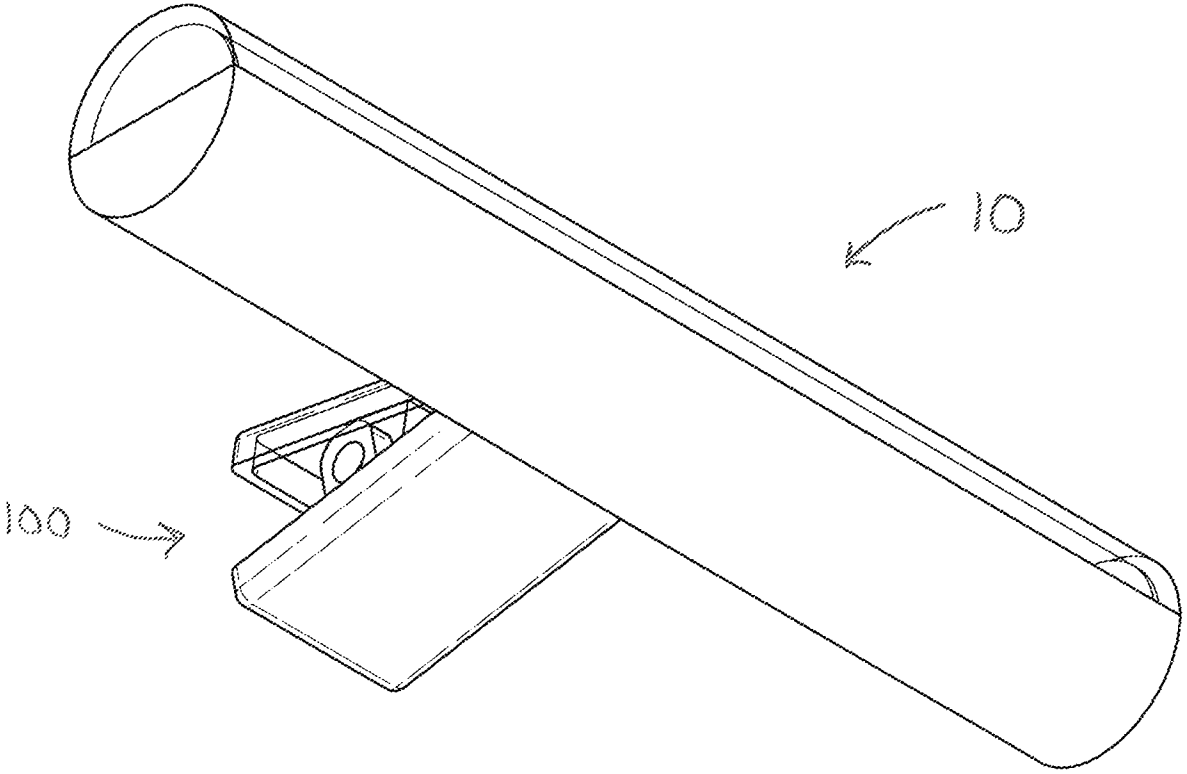
FIG. 2 is a bottom perspective view of the device for pick-up, handling and transport of hazardous waste and paraphernalia forming one aspect of this disclosure.
Figure 3:
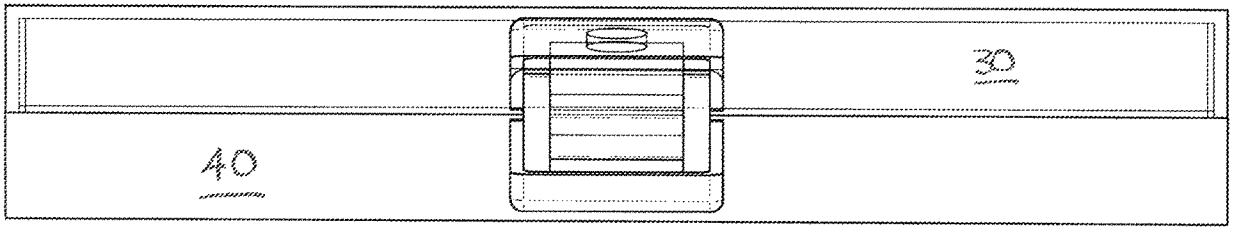
FIG. 3 is a front view of the device for pick-up, handling and transport of hazardous waste and paraphernalia forming one aspect of this disclosure.
Figure 4:
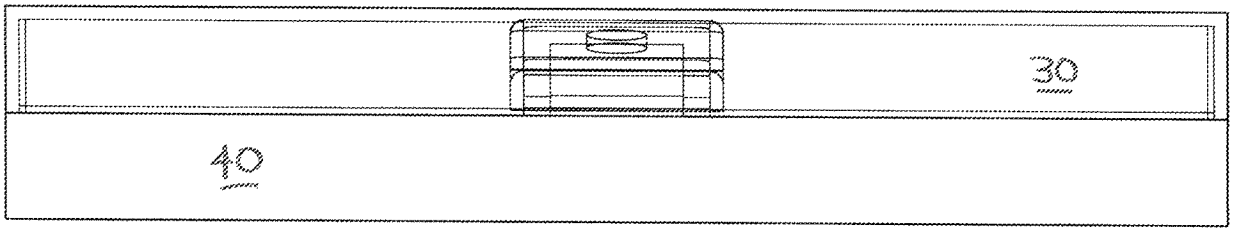
FIG. 4 is a rear view of the device for pick-up, handling and transport of hazardous waste and paraphernalia forming one aspect of this disclosure.
Figure 9:
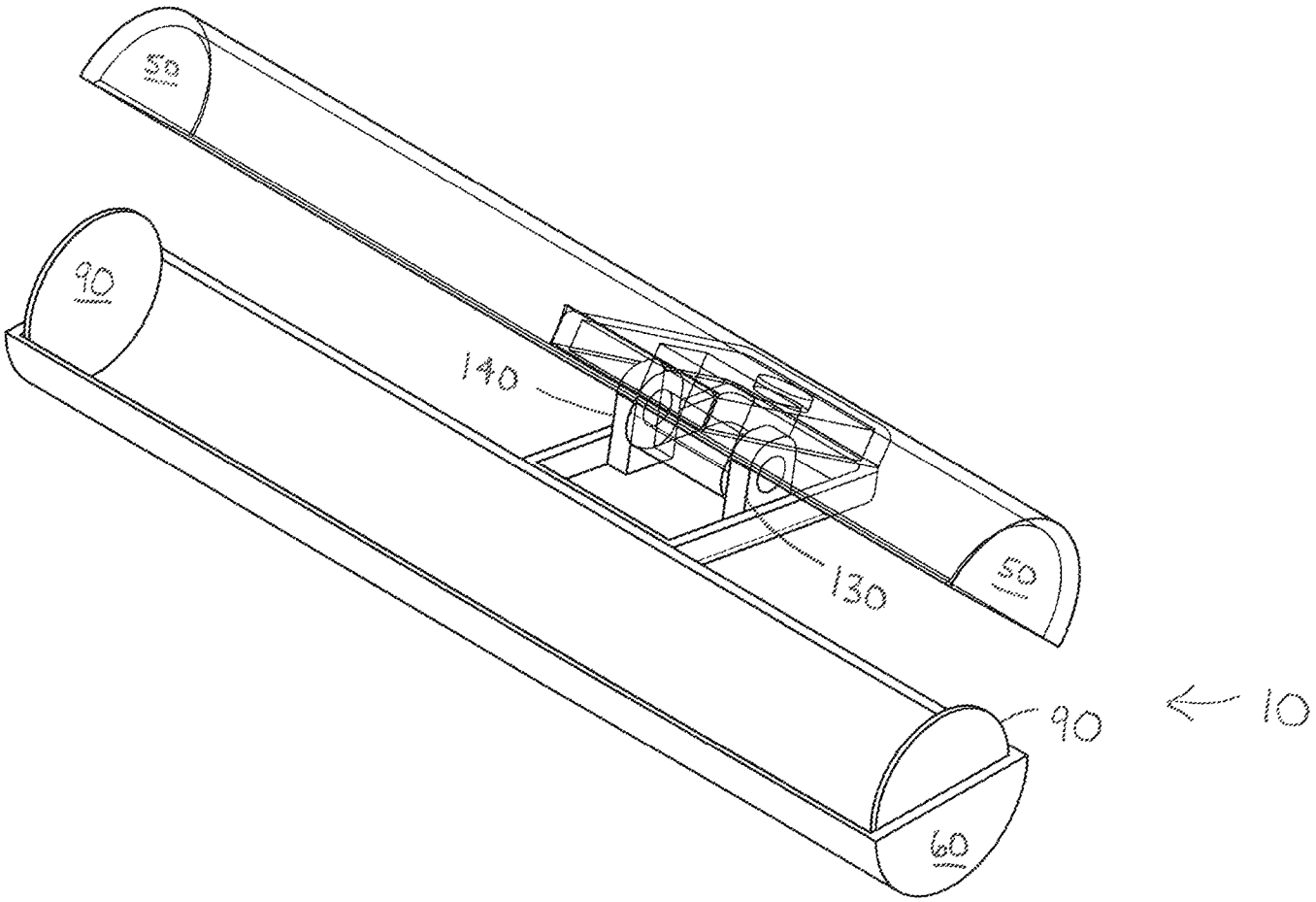
FIG. 9 is a perspective view of the device for pick-up, handling and transport of hazardous waste and paraphernalia in an open configuration forming one aspect of this disclosure.

As shown in FIG. 9, the opposed ends of the top section 30 have half-circle end pieces 50, while the opposed ends of the bottom section 40 have complementary half-circle end pieces 60 such that when the top and bottom sections 30/40 are closed together in a closed or neutral position, the end pieces 50/60 of each section 30/40 form a fully enclosed circle (see FIG. 1). Furthermore, the entire outer edge 70 of top section 30 is flush with the entire outer edge 80 of the bottom section 40 when the sections are in the closed or neutral position as perhaps best illustrated in FIGS. 2-4. The bottom section 40 further includes a circular tab 90 located adjacent to the end pieces on each side (see FIG. 9). The circular tabs 90 on each side of the bottom section 40 extend upward above the edge of the bottom section 40 to at least partially engage the top section 30 when the sections 30/40 are closed together. One of the primary purposes of the tabs 90 is to ensure a better connection between the sections 30/40 in the closed position to ensure a tight fight and prevent loss of the waste products during transportation to an appropriate disposal location.

Figure 6:
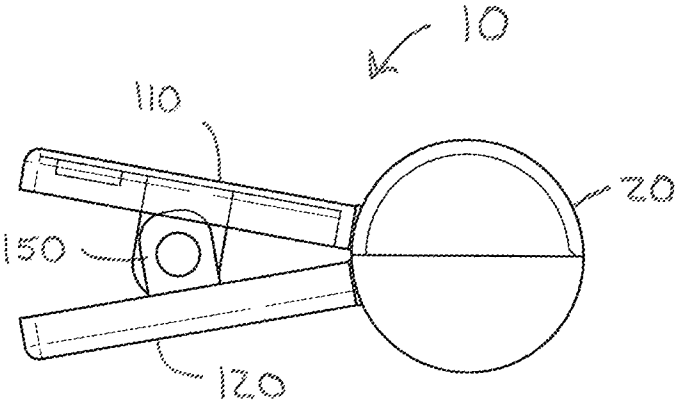
FIG. 6 is an opposite side view of the device for pick-up, handling and transport of hazardous waste and paraphernalia forming one aspect of this disclosure.
Figure 5:
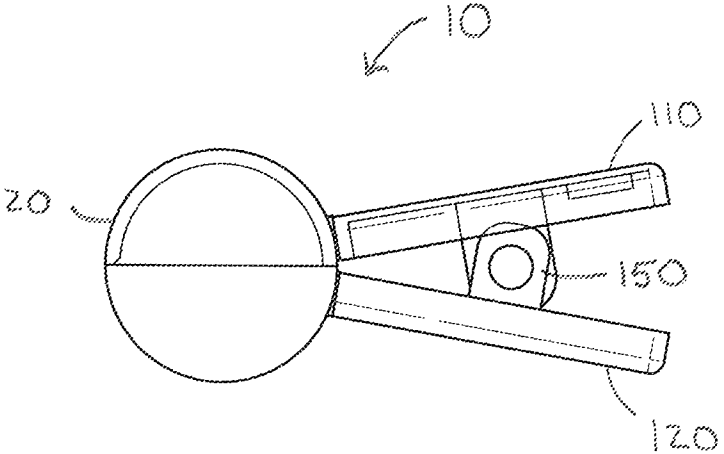
FIG. 5 is a side view of the device for pick-up, handling and transport of hazardous waste and paraphernalia forming one aspect of this disclosure.
Figure 7:
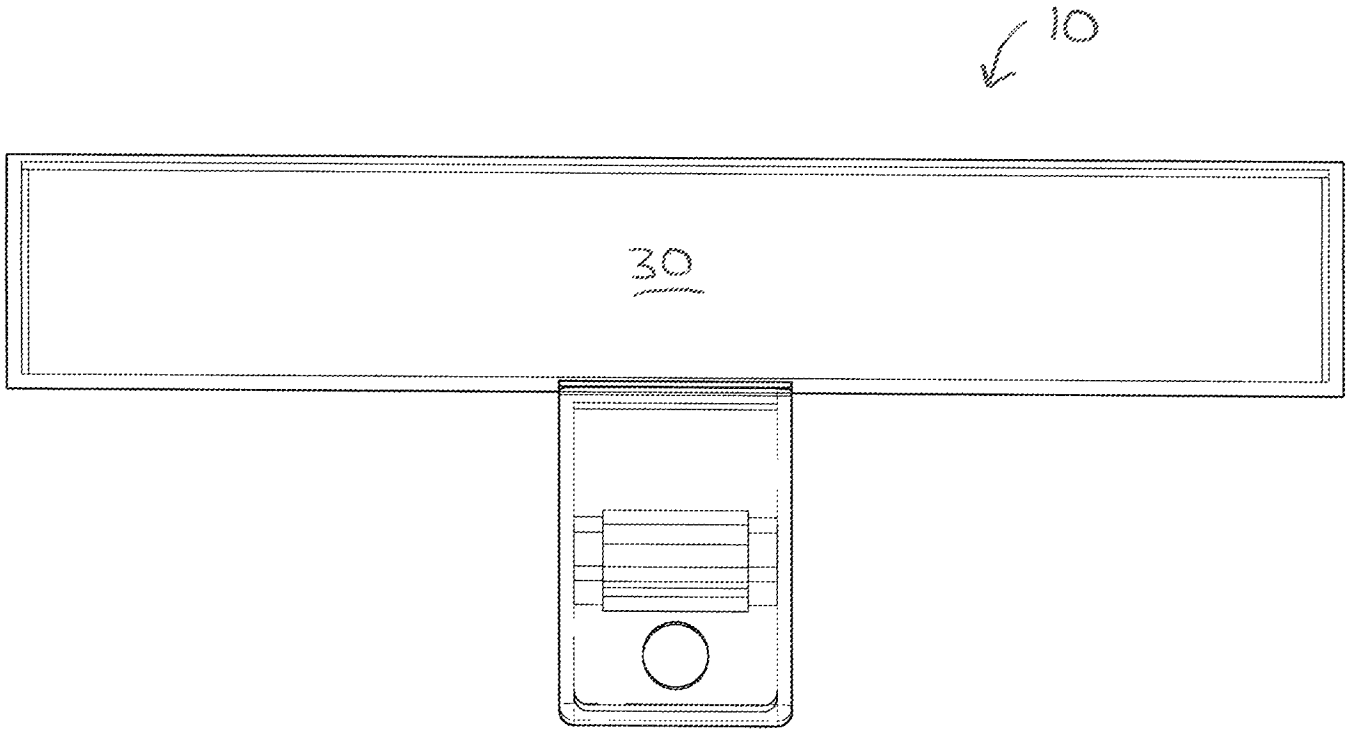
FIG. 7 is a top view of the device for pick-up, handling and transport of hazardous waste and paraphernalia forming one aspect of this disclosure.
Figure 8:
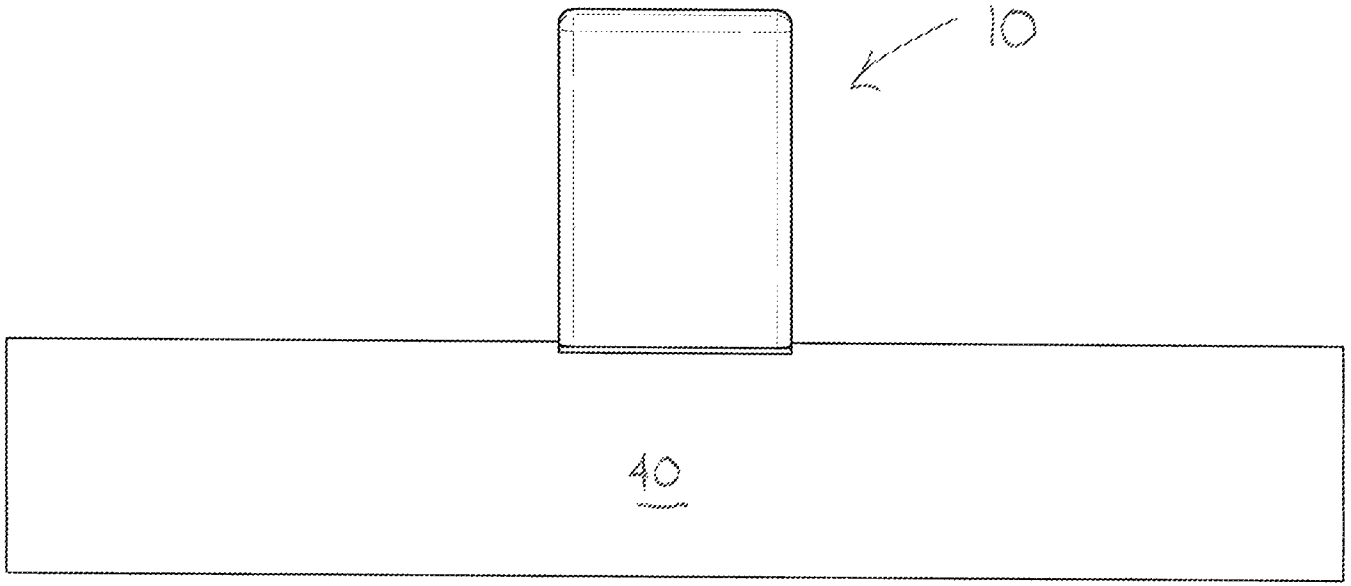
FIG. 8 is a bottom view of the device for pick-up, handling and transport of hazardous waste and paraphernalia forming one aspect of this disclosure.

As perhaps best shown in FIGS. 1, 5 and 6, the top and bottom sections 30/40 are connected via a hinge mechanism such as a clip hinge 100 that operates to move the body 20 from the closed or neutral position wherein the top and bottom sections 30/40 contact each other (forming an enclosed cylinder) and an open or working position wherein the top and bottom sections are separated in order to collect the waste. Of course, it should be appreciated that other mechanisms may be used to connect the top and bottom sections 30/40. In more detail, the clip hinge 100 includes a first upper handle 110 connected to the top section 30 and a second bottom handle 120 connected to the bottom section 40. The upper handle 110 may have two spaced apart downwardly projecting tabs 130 and 140. The lower handle 120 may have a mounting block 150, wherein the downwardly projecting tabs 130/140 are connected to each opposed side of the mounting block. Alternatively, the lower handle 110 may have two spaced apart upwardly projecting tabs, while the upper handle 120 may have a mounting block wherein the upwardly projecting tabs are connected to each opposed side of the mounting block. A screw or other fastener (not shown) may be used to secure the downwardly projecting tabs 130/140 to the mounting block 150. A spring 160 may be positioned behind the mounting block 150 to provide the spring-action to actuate the clip hinge upon the exertion of an external force or pressure by the operator.

In use, without any external force being applied to the handles, the top section 30 and bottom section 40 are in the closed or neutral position as best illustrated in FIG. 1. An operator may apply an external force or pressure by squeezing each handle 110/120 toward each other to activate the spring associated with the clip hinge 100 and moves the top and bottom sections 30/40 from the closed position to the open or working position as perhaps best shown in FIG. 9. In the open position, the top and bottom sections 30/40 may act as tongs for the operator to use to collect waste materials such as needles and syringes. Once the sections 30/40 engage the waste materials, the waste materials settle within the open cavity (C) formed by the hollow interior of the parts. The operator may then release the handles of the clip hinge 100 to allow the top and bottom sections 30/40 to contact each other in a closed position such that the waste materials and/or paraphernalia is completely enclosed to allow for proper handling, transport and disposal of the waste materials.

In one particular embodiment, the device 10 may include a locking mechanism as an additional safety precaution, i.e., to prevent the top and bottom parts from separating and exposing the waste materials in the closed position. In the closed position, the individual may transfer the waste material to a proper disposal location without the waste contacting the individual.

The device provides a number of advantages over the current method and devices of picking up, handling and transporting medical and/or hazardous waste, including but not limited to drug paraphernalia, drugs, spoons, syringes, needles, etc. Initially, the device is a much safer alternative than current methods as in the closed position, the medical and/or hazardous waste is completely enclosed so the individual is protected. Moreover, the hard plastic body prevents needles or syringes enclosed within the body from piercing the body and potentially contacting the individual. The device may be manufactured relatively cheaply, so that they can be used in many areas, including low income areas and easily carried by public workers likely to come into contact with medical and/or hazardous waste. The device may be manufactured to be used with associated dispensers.

The foregoing descriptions of various embodiments have been presented for purposes of illustration and description. These descriptions are not intended to be exhaustive or to limit the invention to the precise forms disclosed. The embodiments described provide the best illustration of the inventive principles and their practical applications to thereby enable one of ordinary skill in the art to utilize the disclosure in various embodiments and with various modifications as are suited to the particular use contemplated.

The invention claimed is:

1. A device for picking up, handling and transporting medical and/or hazardous waste, comprising:

a body having an upper section and a lower section; and a clip hinge connecting the upper section to the lower section, whereby the clip hinge is configured to translate the body between an open position wherein the upper section and the lower section are spaced apart and a closed position wherein the upper section and the lower section are engaged to form a sealed container and wherein the lower section has two opposed circular tabs to engage opposed ends of the upper section in the closed position.

2. The device according to claim 1, wherein the body is cylindrical.

3. The device according to claim 1, wherein the upper section is formed of a transparent plastic material.

4. The device according to claim 3, wherein the lower section is formed of an opaque plastic material.

5. The device according to claim 3, wherein the transparent plastic material is imprinted with a logo or decal.

6. The device according to claim 1, wherein the upper section has a substantially inverted U-shaped cross-section.

7. The device according to claim 6, wherein the lower section has a substantially U-shaped cross-section.

8. The device according to claim 1, wherein an interior of each of the upper and lower sections is substantially hollow defining a cavity for holding and transporting waste products.

9. A device for picking up, handling and transporting medical and/or hazardous waste, comprising:

a first section having a first hollow interior;

a second section opposed to the first section, said second section having a second hollow interior, wherein the first and second sections are movable between an open position and a closed position;

a handle connecting the first section to the second section, wherein the handle includes a first portion connected to the first section and a second portion connected to the second section, wherein the first portion of the handle and the second portion of the handle are connected via a hinge mechanism, and wherein the hinge mechanism includes two opposed projecting tabs connected to a mounting block; and a spring for the handle.

10. The device according to claim 9, wherein the first hollow interior and the second hollow interior define a cavity for holding waste in the closed position.

11. The device according to claim 9, wherein the first section has a first outer edge extending around an entirety of the first section and the second section has a second outer edge extending around an entirety of the second section.

12. The device according to claim 11, wherein the first outer edge is substantially flush with the second outer edge in the closed position.

13. The device according to claim 9, wherein the two opposed projecting tabs are connected to the mounting block via a fastener.

* * * * *